US011180221B2

(12) United States Patent
Reuter

(10) Patent No.: US 11,180,221 B2
(45) Date of Patent: Nov. 23, 2021

(54) MOORING APPARATUS AND SYSTEM

(71) Applicant: Ronald J. Reuter, Milford, CT (US)

(72) Inventor: Ronald J. Reuter, Milford, CT (US)

( * ) Notice: Subject to any disclaimer, the term of this patent is extended or adjusted under 35 U.S.C. 154(b) by 14 days.

(21) Appl. No.: 16/879,932

(22) Filed: May 21, 2020

(65) Prior Publication Data

US 2020/0369346 A1 Nov. 26, 2020

Related U.S. Application Data

(60) Provisional application No. 62/851,302, filed on May 22, 2019.

(51) Int. Cl.
*B63B 22/02* (2006.01)
*B63B 21/46* (2006.01)

(52) U.S. Cl.
CPC ..... *B63B 21/46* (2013.01); *B63B 22/02* (2013.01)

(58) Field of Classification Search
USPC ..... 441/3; 114/230.2, 230.26, 230.3
See application file for complete search history.

(56) References Cited

U.S. PATENT DOCUMENTS 1,536,701 A 5/1925 Buckingham
1,801,729 A 4/1931 Elliot
1,852,629 A 4/1932 Sturges
1,921,500 A 8/1933 Blake
2,680,859 A 6/1954 Hultberg
2,764,792 A * 10/1956 Mansfield ..... B63B 21/54 24/375
2,943,590 A 7/1960 Andersen
3,077,614 A 2/1963 Lloyd
3,167,793 A 2/1965 Keats
3,431,568 A 3/1969 Brown
(Continued)

FOREIGN PATENT DOCUMENTS

AU 9733200 A * 2/1998
EP 0354327 2/1990
(Continued)

OTHER PUBLICATIONS

Mantus Marine, Mooring Snap Shackle Demo, URL: https://www.youtube.com/watch?v=paXSbr_dfD8&feature=youtu.be, Jan. 14, 2019.
(Continued)

*Primary Examiner* — Sunil Singh
(74) *Attorney, Agent, or Firm* — Michael A. Blake

(57) ABSTRACT

A mooring ball system comprising: a mooring ball; a collar attached to the top of the mooring ball; an extendible, retractable, and lockable mast attached to the collar, and extending from the top of the mooring ball; a hook attached near or at the top of the mast; a chain attached to the mooring ball; a mooring line attached to the chain; a loop located at one end of the mooring line; and where the loop is configured to removeably attach to the hook, and where the loop is further configured to be removed from the hook and attached to a watercraft. A mooring apparatus comprising: a collar configured to attach to the top of a mooring ball; an extendible, retractable, and lockable mast configured to attach to the collar, and configured to extend from the top of the mooring ball; and a hook attached near or at the top of the mast.

13 Claims, 6 Drawing Sheets

(56) References Cited

U.S. PATENT DOCUMENTS

| | | | |
|---|---|---|---|
| 4,529,388 | A | 7/1985 | Jones |
| 5,520,134 | A | 5/1996 | Walker |
| 6,488,554 | B2 | 12/2002 | Walker |
| 6,907,837 | B2 | 6/2005 | Pufahl |
| D602,389 | S | 10/2009 | Gilman |
| 8,568,180 | B1 | 10/2013 | DeHoney |
| 2010/0171312 | A1 | 7/2010 | Burns |

FOREIGN PATENT DOCUMENTS

| | | | | |
|---|---|---|---|---|
| GB | 2209146 | | | 5/1989 |
| GB | 2558542 | A | * | 7/2018 |
| KR | 101531321 | B1 | * | 6/2015 |
| WO | WO2018100328 | | | 6/2018 |

OTHER PUBLICATIONS

Lee Young, International Search Report and Written Opinion, PCT/US2020/034160, dated Aug. 25, 2020.

* cited by examiner

MOORING APPARATUS AND SYSTEM

CROSS-REFERENCES

This patent application claims priority to provisional patent application No. 62/851,302, filed on May 22, 2019, by Ronald J. Reuter and titled: "MOORING APPARATUS AND SYSTEM" which provisional application is fully incorporated by reference herein.

TECHNICAL FIELD

This invention is related to mooring apparatuses, and more particularly to an apparatus which aids in the mooring of a boat at a mooring buoy.

BACKGROUND

In the operation of small boats, it is frequently necessary to moor the boat away from the dock usually by attaching a mooring line to a buoy having a mooring ring. Since the ring or hoop carried by the buoy may be several feet beyond the reach of the boat operator, considerable difficulty is often encountered in securing the clip on the end of a mooring line to the mooring buoy and in inclement weather a certain degree of danger may be involved. In addition, the mooring line is usually in the water, making the line wet, covered in slime, and difficult and unappealing to handle. Similar difficulties are encountered in disengaging the mooring line and in rough weather the difficulties may be sufficient to require the cutting of the mooring line rather than the disengagement of the line from the buoy. Despite these difficulties and attendant occasional hazards, it is the general practice to attach a clip on the end of a mooring line to the ring of a mooring buoy by manually bringing the parts together. Alternate the mooring line may be threaded through the loop on the mooring buoy and secured with a knot. In either case the actions required are awkward, difficult and occasionally dangerous. Reaching the buoy to tie the mooring line can be difficult. In the case of the dock rail, at least two persons are usually necessary; one person jumps onto the dock to tie the mooring line while another remains aboard to pilot the boat. One person pilots the boat while the second person reaches down for the buoy and pulls it up to tie the line. If the buoy cannot be pulled up, due to factors such as its weight or tension in its anchor line, the second person must reach down to the buoy while tying the line. These procedures can present real difficulties and even hazards to a boater. An unassisted boater may even find it impossible to moor his boat. Reaching over the side of the boat to a buoy may be dangerous, especially in rough waters (a time when the buoy anchor line is likely to be in tension such that the buoy cannot be lifted).

Thus there is a need for a mooring apparatus and system that overcomes the above listed and other disadvantages.

SUMMARY OF THE INVENTION

The invention relates to a mooring ball system comprising: a mooring ball; a collar attached to the top of the mooring ball; an extendible, retractable, and lockable mast attached to the collar, and extending from the top of the mooring ball; a hook attached near or at the top of the mast; a chain attached to the mooring ball; a mooring line attached to the chain; a loop located at one end of the mooring line; and where the loop is configured to removeably attach to the hook, and where the loop is further configured to be removed from the hook and attached to a watercraft.

The invention also relates to a mooring apparatus comprising: a collar configured to attach to the top of a mooring ball; an extendible, retractable, and lockable mast configured to attach to the collar, and configured to extend from the top of the mooring ball; and a hook attached near or at the top of the mast.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION OF THE INVENTION

Figure 1:
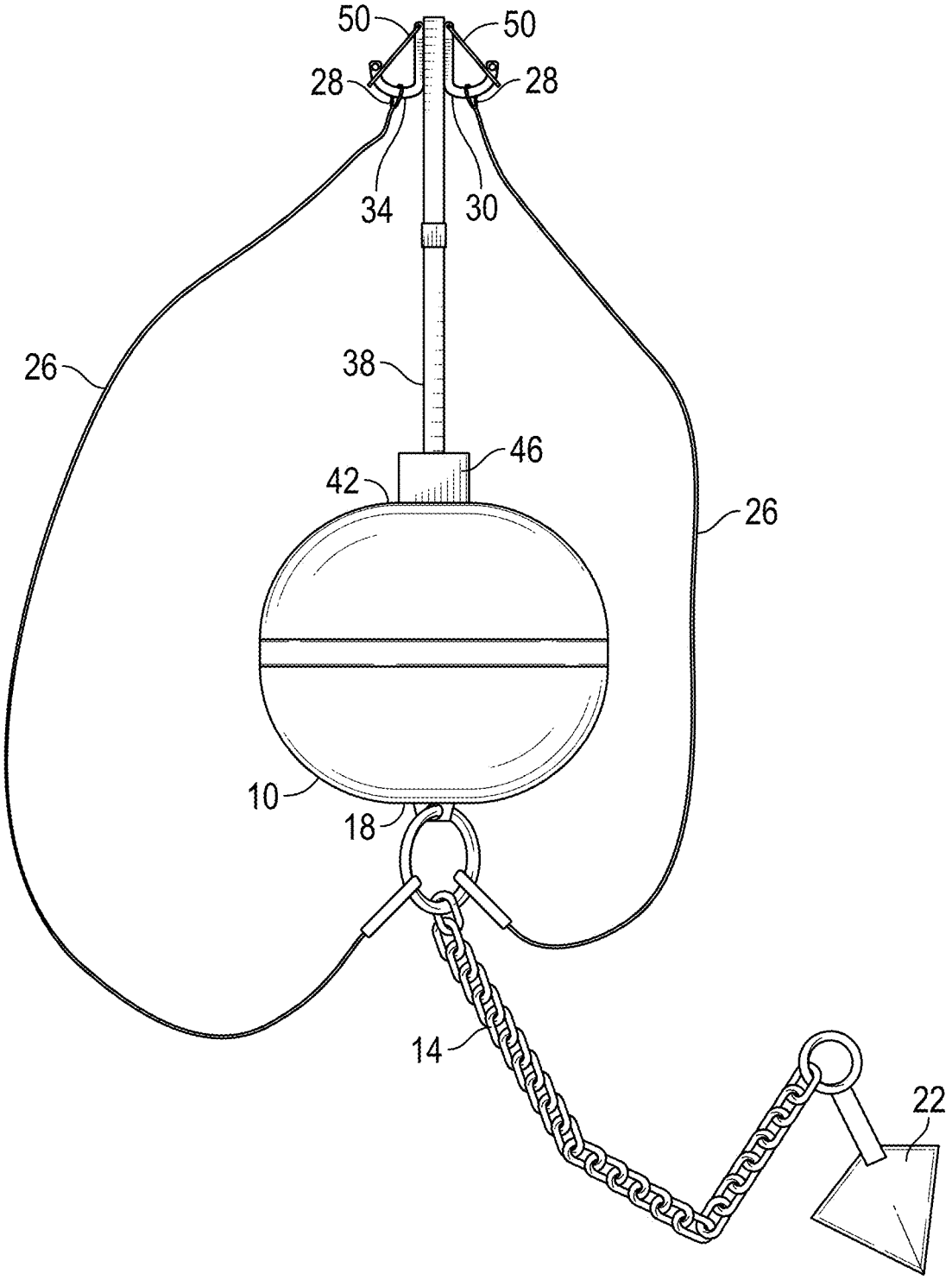
FIG. 1 is a front view of the disclosed mooring system.

FIG. 1 shows a front view of one embodiment of a disclosed mooring system. The mooring ball 10 may be a bottom attached mooring ball 10. A chain or line 14 may be attached to the bottom 18 of the mooring ball, and the chain 14 is attached to the floor of the body of water, in this embodiment by an anchor 22. A mooring line 26 is attached to the bottom 18 of the mooring ball 10, or to the chain 14. In this embodiment, the mooring line 26 is removably attached to a first hook 30 attached to an extendible and retractable mast 38. The mooring line 26 may have a loop 28 or ring that can be slid over the hook 30. In this document, a loop shall include both a loop and a ring. The mast 38 may be extended or retracted to a particular length desired by the user, and locked at the particular length by the user. The mast 38 may be attached to the top 42 of the mooring ball 10 via a collar 46. In one embodiment, the collar 46 is attached to the mooring ball 10 via attachment means such as but not limited to screws, threads, epoxy, adhesives, or any other suitable attachment or fastening means. In another embodiment, the collar 46 may be attached to the mooring ball via straps, shown in FIG. 4. The mast 38 may have a second hook 34. The hooks 34, 30 may have locking means 50, that may prevent others who are not owners of the mooring ball 10 from using the mooring ball 10.

Figure 2:
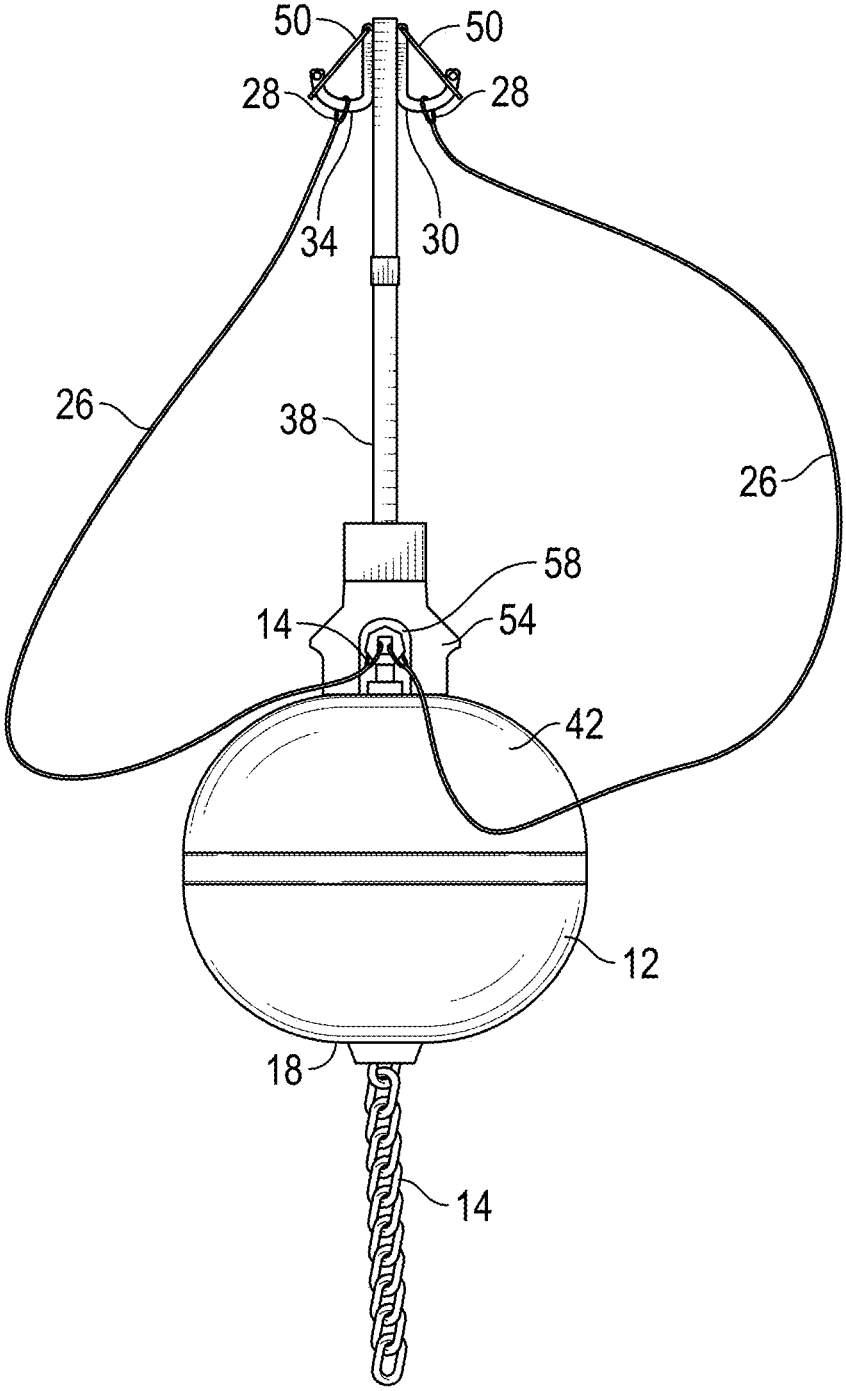
FIG. 2 is a front view of another embodiment of the disclosed mooring system.

FIG. 2 shows a front view of another embodiment of the mooring ball system. In this embodiment, the mooring ball 12 is a top attached mooring ball 12. In a top attached mooring ball 12, the chain 14 goes through the mooring ball 12 at the bottom 18, and exits at the top 42 of the mooring ball 12. A mooring line 26 is attached to the portion of the chain 14 that exits the top 42 of the mooring ball. The mooring line 26 is removably attached to one of the hooks 30, 34. In this embodiment, the mast 38 is attached to a specialized collar 54. The specialized collar has slots 58 or openings that are configured to allow the chain 14 exiting the top 42 of the mooring ball 10, to be accessible to the mooring line 26, via the slots 58, so that the mooring line 26 can be attached to the chain 14. In one embodiment, the specialized collar 54 is attached to the mooring ball 12 via attachment means such as but not limited to screws, threads, epoxy, adhesives, etc. In another embodiment, the specialized collar 54 may be attached to the mooring ball 12 via straps.

Figure 3:
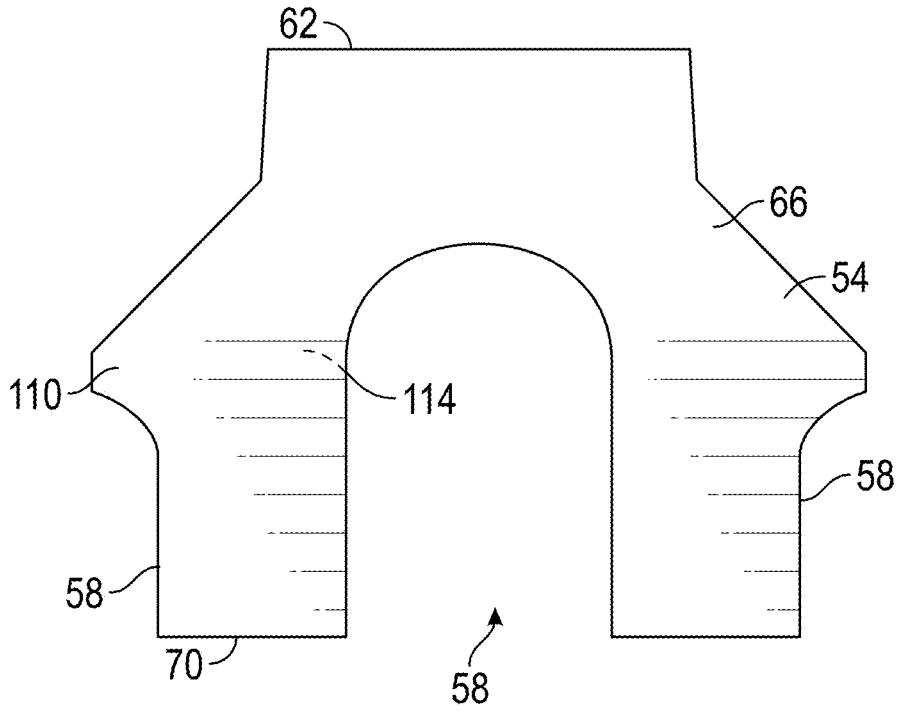
FIG. 3 is a detailed view of the specialized collar.

FIG. 3 is a front view of one embodiment of the specialized collar 54. The collar 54 has a mast attachment means 62 located at the top 66 of the collar 54. Located radially about the collar 54 and adjacent to the bottom 70 of the collar is a plurality of slots 58. The slots are configured to allow the chain 14 and mooring line 26 to exit the top of the mooring ball 12 and not be blocked by the collar 54. The collar 54 comprises body portion 110. The body portion 110 contains a generally hollow interior 114. The hollow interior 114 allows a portion of the chain 14 to extend through the top of the mooring ball 12 and be located in the hollow interior. The slots 58 allow the mooring line 26 to attach to the chain 14.

Figure 4:
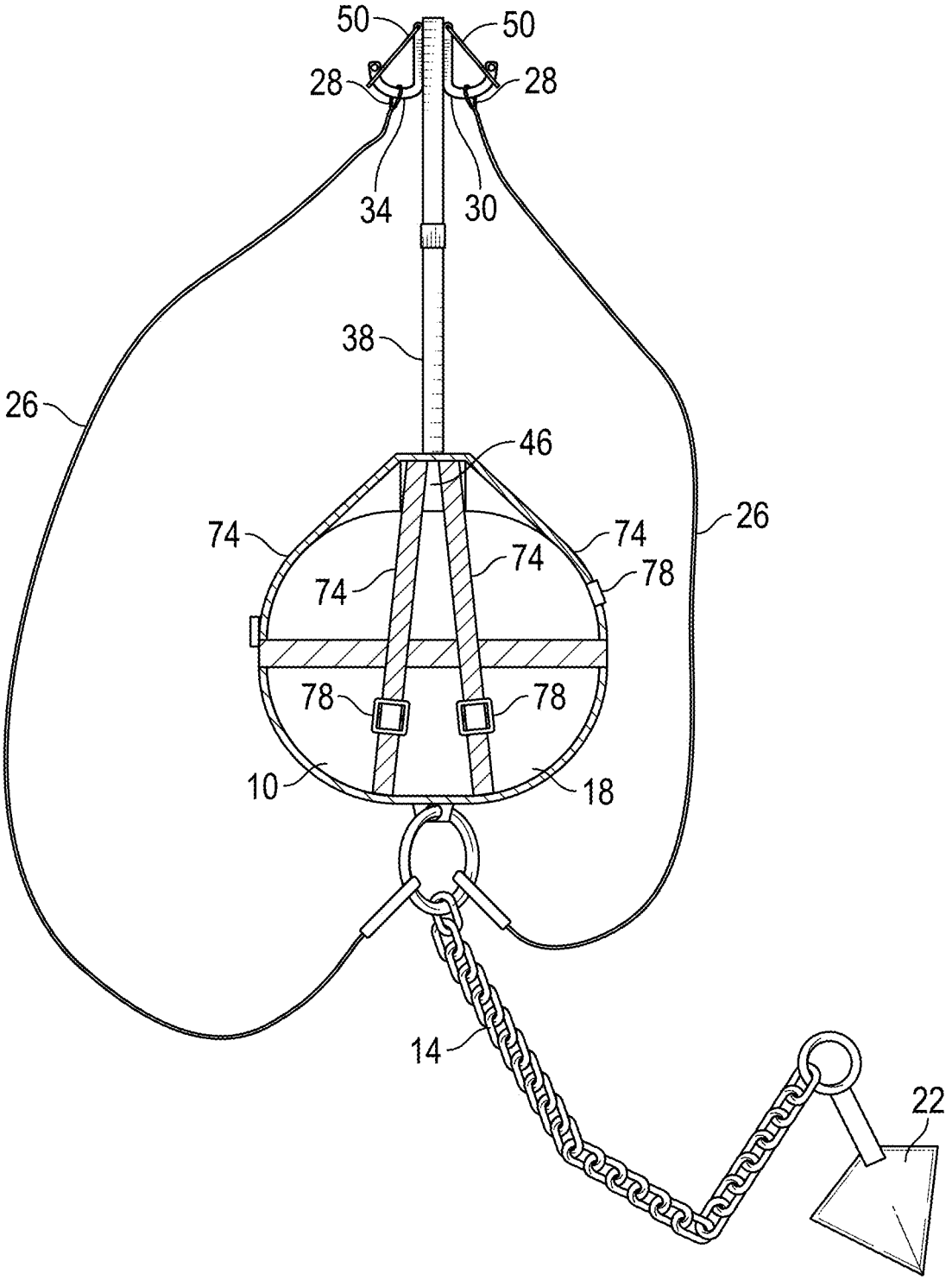
FIG. 4 is a front view of a strap embodiment of the disclosed mooring system.

FIG. 4 is a front view of one embodiment of using a plurality of straps 74 to attach the collar 46 to the mooring ball 10. The straps 74 generally wrap around the mooring ball 10, and may be tightened to the mooring ball via buckles 78, or other strap tightening means, including but not limited to hook and loop means, snaps, strap holes and strap buckles with prongs, tri-glide buckles, strap ratchets, cam buckles, ladderlock buckles, and side release buckles with a length adjustment means.

Figure 5:
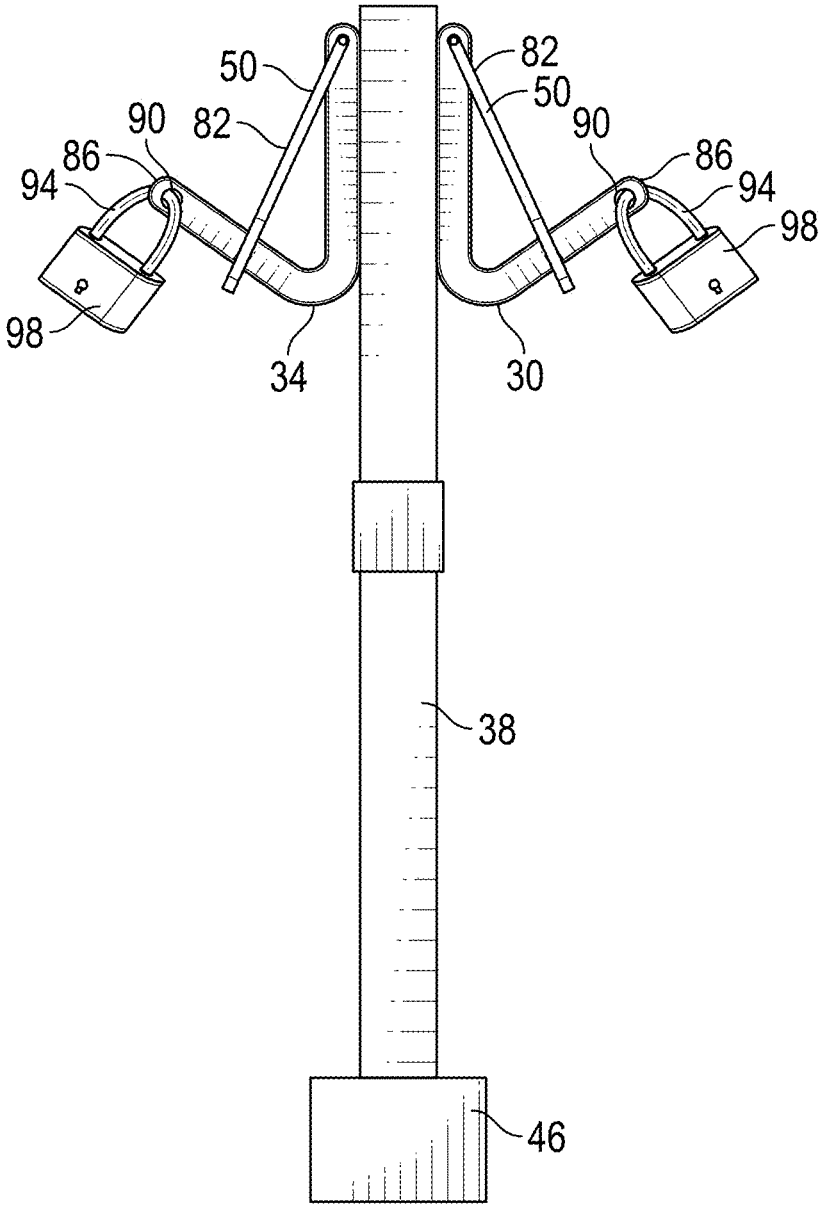
FIG. 5 is a detailed view of the locking system.

FIG. 5 is a close up view of the locking means 50. In one embodiment, the locking means 50 may be a rotatable locking member 82 with an opening that is configured to slide over the end 86 of one of the hooks 30, 34. The ends 86 of the hooks 30, 34 may have an opening 90 configured to accept the shank 94 of a padlock 98.

Figure 6:
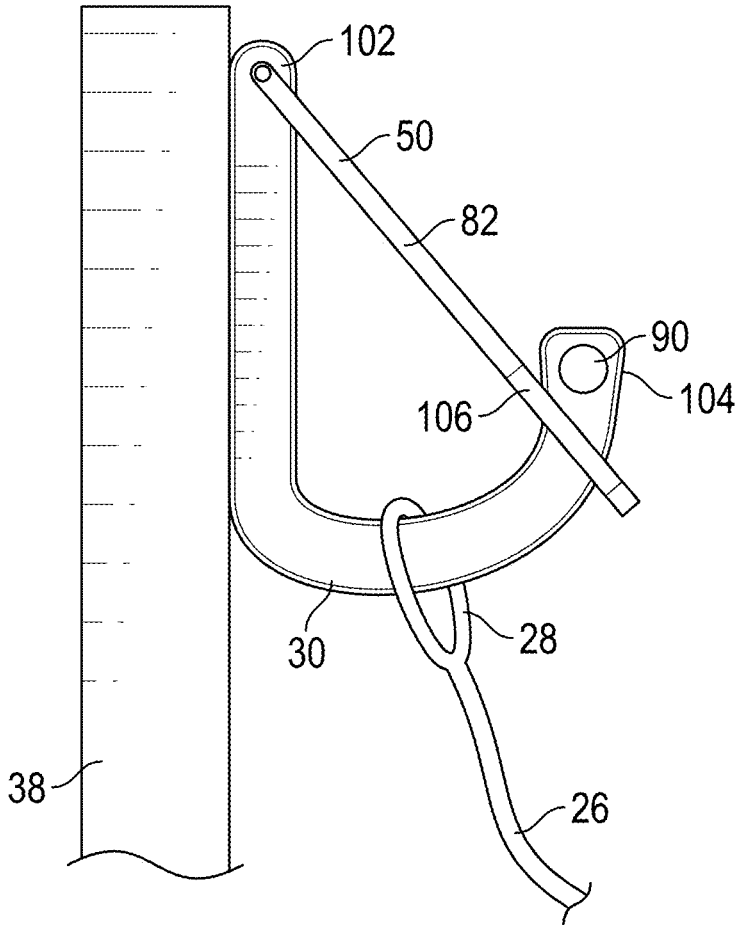
FIG. 6 is a detailed view of the hook.

FIG. 6 is a close up view of one of the hooks 30. The hook 30 comprises a top end 102, and a distal end 104 located away from the mast 38. The rotatable locking member 82 may be rotatably attached to the top end 102 or near the top end 102. The rotatable locking member 82 may have an opening 106 (shown in dashed line) configured to slide over the distal end 104. The opening 90 is configured to accept the shank of a lock. When the shank of the lock is slid through the opening 90, and locked, then the mooring line loop 28 is locked in place, and only the owner of the lock can release the loop 28 and the mooring line 26. One of ordinary skill in the art will recognize that other locking means may be employed to lock the loop 28 with respect to the hook 30, 34.

The mooring balls 10 and 12 may be retrofitted to accept the collars 46, 54 and mast 38. In other embodiments, mooring balls may be built with attachment means for the collars 46, 54, or the collars 46, 54 may be built-in with the mooring balls.

In use, a user may approach the mooring system with his or her watercraft. The user would be able to easily grab a mooring line 26 hanging from the hook 30, 34. The mooring line 26 will generally dry and easy to handle since it is not beneath the water's surface. The user then attaches his or her vessel to the mooring line 26, to secure the watercraft. In one embodiment, the user simply slides the mooring line 26 off the hook. In other embodiments, the user unlocks the padlock 98, lifts the locking member 82, and then slides the mooring line 26 off the hook 30, 34. If the hooks 30, 34 are too high or too low, the user can adjust the height of the mast 38 since it is extendible and retractable, and lock the height in place.

The disclosed mooring apparatus and system has many advantages. The disclosed mooring apparatus and system makes it easier and safer for a user to access lines from the bow under moving seas and for a single operator. The mooring lines will stay dry and free of debris, and free mussel build up (sharp edges). The mooring lines will not be submerged subjecting them to being tangled and caught in props from the user's watercraft or other watercrafts. The mooring lines will be kept out of the water and visible for retrieval accessibility. The disclosed system will speed up the user's ability to access the mooring lines. A user can adjust the length of the mast so that the mooring lines are easy to reach by the user, whether the user is on a boat, ship, other seagoing vessel, watercraft or dock. The disclosed system can be retrofitted by the user onto mooring balls he or she already owns or uses.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A mooring ball system comprising:

a mooring ball;

a collar attached to the top of the mooring ball;

an extendible, retractable, and lockable mast attached to the collar, and extending from the top of the mooring ball, a hook attached near or at the top of the mast;

a chain attached to the mooring ball;

a mooring line attached to the chain;

a loop located at one end of the mooring line; and a bottom opening at the bottom of the mooring ball;

a top opening at the top of the mooring ball;

a cavity between the bottom opening and the top opening configured for the chain to enter the bottom opening and exit the top opening;

wherein the collar comprises:

a body portion;

a top portion attached to the top of the body portion, the body portion containing a generally hollow interior, and the hollow interior configured to allow a portion of the chain to extend through the top of the mooring ball and be located in the hollow interior;

a mast attachment means located in the top portion; and a first slot located in the body portion, the first slot configured to allow a mast line to attach to the portion of the chain located in the hollow interior, and further allow the mast line to exit the hollow interior of the first slot, and removeably attach to the hook.

2. The mooring ball system of claim 1, further comprising:

a locking member attached to the hook, the locking member configured to lock the loop in place.

3. The mooring ball system of claim 2, further comprising:

a key or combination, the key or combination configured to unlock the locking member.

4. The mooring ball system of claim 1, further comprising:

a top end of the hook, a distal end of the hook located away from the mast;

a shank opening located at or near the distal end of the hook;

a rotatable locking member rotatably attached to the top end of the hook, the rotatable locking member having an opening configured to slide over the distal end of the hook; and a lock with a shank, wherein the shank is configured to slide through the shank opening, thereby locking the loop within the hook when the lock is locked.

5. The mooring ball system of claim 1, further comprising:

an opening located at the top of the mooring ball, the opening having ball threads; and collar threads located on the collar, wherein the collar threads are configured to mate the with ball threads to hold the collar in place on the mooring ball.

6. The mooring ball system of claim 1, further comprising:

a plurality of adjustable straps configured to attach the collar to the top of a mooring ball.

7. The mooring ball system of claim 1, wherein the collar further comprises:

a second slot located in the body portion and radially disposed on the collar from the first slot, the second slot configured to allow a mast line to attach to the portion of the chain located in the hollow interior, and further allow the mast line to exit the hollow interior of the slot, and removeably attach to the hook; and wherein the loop is configured to removeably attach to the hook, and wherein the loop is further configured to be removed from the hook and attached to a watercraft.

8. A mooring apparatus comprising:

a collar configured to attach to the top of a mooring ball, the collar comprising:

a body portion;

a top portion attached to the top of the body portion, the body portion containing a generally hollow interior, and the hollow interior configured to allow a portion of a chain to extend through the top of the mooring ball and be located in the hollow interior;

a mast attachment means located in the top portion; and a first slot located in the body portion, the first slot configured to allow a mast line to attach to the portion of the chain located in the hollow interior, and further allow the mast line to exit the hollow interior of the slot, and removeably attach to the hook;

an extendible, retractable, and lockable mast configured to attach to the collar, and configured to extend from the top of the mooring ball; and a hook attached near or at the top of the mast.

9. The mooring apparatus of claim 8, further comprising:

a plurality of adjustable straps configured to hold the collar to the top of a mooring ball.

10. The mooring apparatus 8, wherein the collar further comprises:

a second slot located in the body portion and radially disposed on the collar from the first slot, the second slot configured to allow a mast line to attach to the portion of the chain located in the hollow interior, and further allow the mast line to exit the hollow interior of the slot, and removeably attach to the hook.

11. The mooring apparatus of claim 8, further comprising:

a locking member attached to the hook, the locking member configured to lock a loop attached to an end of a mooring line in place.

12. The mooring apparatus f claim 11, further comprising:

a key or combination, the key or combination configured to unlock the locking member.

13. The mooring apparatus 8, further comprising:

a top end of the hook, a distal end of the hook located away from the mast;

a shank opening located at or near the distal end of the hook;

a rotatable locking member rotatably attached to the top end of the hook, the rotatable locking member having an opening configured to slide over the distal end of the hook; and a lock with a shank, wherein the shank is configured to slide through the shank opening, thereby locking a loop attached to an end of a mooring line when the lock is locked.

* * * * *